US008785359B2

(12) United States Patent
Yaguchi et al.

(10) Patent No.: US 8,785,359 B2
(45) **Date of Patent: *Jul. 22, 2014**

(54) LUBRICANT OIL COMPOSITION

(75) Inventors: Akira Yaguchi, Tokyo (JP); Shigeki Matsui, Tokyo (JP); Teppei Tsujimoto, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 133 days.

This patent is subject to a terminal disclaimer.

(21) Appl. No.: 13/375,061

(22) PCT Filed: Jan. 25, 2010

(86) PCT No.: PCT/JP2010/050921

§ 371 (c)(1),
(2), (4) Date: Nov. 29, 2011

(87) PCT Pub. No.: WO2010/140392

PCT Pub. Date: Dec. 9, 2010

(65) Prior Publication Data

US 2012/0071374 A1 Mar. 22, 2012

(30) Foreign Application Priority Data

Jun. 4, 2009 (JP) ..... 2009-135447

(51) Int. Cl.
*C10M 145/14* (2006.01)
*C10M 173/02* (2006.01)

(52) U.S. Cl.
USPC ..... 508/469; 508/507; 508/472

(58) Field of Classification Search
USPC ..... 508/469, 472, 507
See application file for complete search history.

(56) References Cited

U.S. PATENT DOCUMENTS

| | | | |
|---|---|---|---|
| 2,861,941 | A | 11/1958 | Jancosek et al. |
| 2,890,161 | A | 6/1959 | Brown et al. |
| 3,078,222 | A | 2/1963 | Henke et al. |
| 3,847,790 | A | 11/1974 | Putz |
| 4,021,357 | A | 5/1977 | Morduchowitz et al. |
| 4,867,894 | A | 9/1989 | Pennewiss et al. |
| 5,282,958 | A | 2/1994 | Santilli et al. |
| 5,362,378 | A | 11/1994 | Borghard et al. |
| 5,652,201 | A | 7/1997 | Papay et al. |
| 5,763,374 | A | 6/1998 | Sakai et al. |
| 5,955,405 | A | 9/1999 | Liesen et al. |
| 6,077,455 | A | 6/2000 | Bloch et al. |
| 6,090,989 | A | 7/2000 | Trewella et al. |
| 6,383,366 | B1 | 5/2002 | Riley et al. |
| 6,602,402 | B1 | 8/2003 | Benazzi et al. |
| 7,285,206 | B2 | 10/2007 | Germaine |
| 7,867,957 | B2 | 1/2011 | Matsui et al. |
| 2001/0056044 | A1 | 12/2001 | Kinker et al. |
| 2002/0119896 | A1 | 8/2002 | Yagishita et al. |
| 2003/0036488 | A1 | 2/2003 | Yuki et al. |
| 2003/0104955 | A1 | 6/2003 | Yuki et al. |
| 2003/0162673 | A1 | 8/2003 | Kurihara et al. |
| 2003/0226785 | A1 | 12/2003 | Murphy et al. |
| 2004/0045868 | A1 | 3/2004 | Germaine |
| 2004/0065588 | A1 | 4/2004 | Genetti et al. |
| 2004/0077509 | A1 | 4/2004 | Yuki et al. |
| 2004/0079675 | A1 | 4/2004 | Germaine et al. |
| 2004/0092409 | A1 | 5/2004 | Liesen |
| 2004/0099571 | A1 | 5/2004 | Germaine et al. |
| 2004/0108249 | A1 | 6/2004 | Cody et al. |
| 2004/0112792 | A1 | 6/2004 | Murphy et al. |
| 2004/0119046 | A1 | 6/2004 | Carey et al. |
| 2004/0129603 | A1 | 7/2004 | Fyfe et al. |
| 2004/0154957 | A1 | 8/2004 | Keeney et al. |
| 2004/0154958 | A1 | 8/2004 | Alexander et al. |
| 2004/0198616 | A1 | 10/2004 | Hirao et al. |

(Continued)

FOREIGN PATENT DOCUMENTS

| | | |
|---|---|---|
| CA | 2 682 660 | 10/2008 |
| CN | 1279708 | 1/2001 |

(Continued)

OTHER PUBLICATIONS

Office Action issued with respect to Chinese Patent Application No. 201080024832.7, mailed Dec. 12, 2012.
Office Action issued with respect to U.S. Appl. No. 12/812,524, mailed Jan. 22, 2013.
U.S. Appl. No. 13/322,975 to Shigeki Matsui et al., which was filed Nov. 29, 2011.
U.S. Appl. No. 13/375,122 to Akira Yaguchi et al., which was filed Nov. 29, 2011.
U.S. Appl. No. 13/375,365 to Shigeki Matsui et al., which was filed Nov. 30, 2011.

(Continued)

*Primary Examiner* — Prem C Singh
*Assistant Examiner* — Francis C Campanell
(74) *Attorney, Agent, or Firm* — Greenblum & Bernstein, P.L.C.

(57) ABSTRACT

A lubricant oil composition comprising: a lubricant base oil whose kinematic viscosity at 100° C. is 1 to 6 $mm^2/s$, % $C_P$ is not less than 70, and % $C_A$ is not more than 2; a first viscosity index improver in which the ratio A/B of a viscosity increasing effect A in the equation (1) to a viscosity increasing effect B in the equation (2) when added to the lubricant base oil is a value of not less than 4.5, and a PSSI is not more than 30; and a second viscosity index improver in which the ratio A/B when added to the lubricant base oil is a value less than 4.5:

$$A=X-X_0 \quad (1)$$

$$B=Y-Y_0 \quad (2)$$

wherein A represents a viscosity increasing effect of the kinematic viscosity at 100° C., B represents a viscosity increasing effect of the HTHS viscosity at 150° C., X represents a kinematic viscosity at 100° C. of a mixture of the lubricant base oil with 3% by mass of the first or second viscosity index improver, $X_0$ represents a kinematic viscosity at 100° C. of the lubricant base oil, Y represents an HTHS viscosity at 150° C. of a mixture of the lubricant base oil with 3% by mass of the first or second viscosity index improver, and $Y_0$ represents an HTHS viscosity at 150° C. of the lubricant base oil.

3 Claims, No Drawings

(56) References Cited

U.S. PATENT DOCUMENTS

| | | | |
|---|---|---|---|
| 2004/0224860 | A1 | 11/2004 | Baba et al. |
| 2005/0077209 | A1 | 4/2005 | Miller et al. |
| 2005/0221998 | A1 | 10/2005 | Marumo et al. |
| 2006/0027486 | A1 | 2/2006 | Rosenbaum et al. |
| 2006/0052252 | A1 | 3/2006 | Wedlock |
| 2006/0172900 | A1 | 8/2006 | Yagishita et al. |
| 2006/0205610 | A1 | 9/2006 | Rosenbaum et al. |
| 2007/0032392 | A1 | 2/2007 | Yokoyama et al. |
| 2007/0138032 | A1 | 6/2007 | Agarkov |
| 2007/0138052 | A1 | 6/2007 | Kobayashi et al. |
| 2007/0191239 | A1 | 8/2007 | Matsuoka et al. |
| 2007/0238627 | A1 | 10/2007 | Haire et al. |
| 2007/0287643 | A1 | 12/2007 | Matsui et al. |
| 2008/0015400 | A1 | 1/2008 | Matsui et al. |
| 2008/0029430 | A1 | 2/2008 | Loh et al. |
| 2008/0029431 | A1 | 2/2008 | Alexander et al. |
| 2008/0110799 | A1 | 5/2008 | Matsui et al. |
| 2008/0248981 | A1 | 10/2008 | Matsui et al. |
| 2009/0005278 | A1 | 1/2009 | Takeuchi et al. |
| 2009/0075852 | A1 | 3/2009 | Yagishita et al. |
| 2009/0221461 | A1 | 9/2009 | Visger et al. |
| 2009/0312208 | A1 | 12/2009 | Ishikawa et al. |
| 2010/0016195 | A1 | 1/2010 | Shirahama et al. |
| 2010/0035777 | A1 | 2/2010 | Sano et al. |
| 2010/0041572 | A1 | 2/2010 | Sano et al. |
| 2010/0093578 | A1 | 4/2010 | Tsujimoto et al. |
| 2010/0130395 | A1 | 5/2010 | Tagawa et al. |
| 2010/0144571 | A1 | 6/2010 | Shirahama et al. |
| 2010/0190671 | A1 | 7/2010 | Stoehr et al. |
| 2011/0003725 | A1 | 1/2011 | Matsui et al. |
| 2011/0021394 | A1 | 1/2011 | Nakao et al. |
| 2011/0042267 | A1 | 2/2011 | Hayasaka |
| 2011/0049008 | A1 | 3/2011 | Tagawa et al. |
| 2011/0049009 | A1 | 3/2011 | Tagawa et al. |
| 2011/0053815 | A1 | 3/2011 | Matsui et al. |
| 2011/0065618 | A1 | 3/2011 | Tagawa |
| 2011/0124536 | A1 | 5/2011 | Matsui |
| 2011/0218131 | A1 | 9/2011 | Tsujimoto et al. |
| 2011/0230685 | A1 | 9/2011 | Tagawa |
| 2011/0237477 | A1 | 9/2011 | Tagawa et al. |
| 2011/0306530 | A1 | 12/2011 | Manabe et al. |
| 2012/0071373 | A1 | 3/2012 | Matsui et al. |
| 2012/0071374 | A1 | 3/2012 | Yaguchi et al. |
| 2012/0071375 | A1 | 3/2012 | Yaguchi et al. |

FOREIGN PATENT DOCUMENTS

| | | | |
|---|---|---|---|
| CN | 1751115 | | 3/2006 |
| CN | 1317368 | C | 5/2007 |
| CN | 101065469 | | 10/2007 |
| CN | 101213277 | | 7/2008 |
| CN | 101426879 | | 5/2009 |
| EP | 1 749 876 | | 2/2007 |
| EP | 1 808 476 | | 7/2007 |
| EP | 1 845 151 | | 10/2007 |
| EP | 2 011 855 | | 8/2008 |
| EP | 2 009 074 | | 12/2008 |
| EP | 2 009 704 | | 12/2008 |
| EP | 2 011 854 | | 1/2009 |
| EP | 2 112 217 | | 10/2009 |
| EP | 2135928 | | 12/2009 |
| EP | 2 241 611 | | 10/2010 |
| EP | 2264131 | | 12/2010 |
| EP | 2264133 | | 12/2010 |
| EP | 2 319 908 | | 5/2011 |
| GB | 2407100 | | 4/2005 |
| JP | S30-000624 | | 2/1955 |
| JP | S31-003928 | | 5/1956 |
| JP | S45-019183 | | 7/1970 |
| JP | S48-025003 | | 4/1973 |
| JP | 63-223094 | | 9/1988 |
| JP | S63-309592 | | 12/1988 |
| JP | 3-100099 | | 4/1991 |
| JP | 4-30391 | | 2/1992 |
| JP | 4-036391 | | 2/1992 |
| JP | 4-68082 | | 3/1992 |
| JP | 4-120193 | | 4/1992 |
| JP | H5-508876 | | 12/1993 |
| JP | 6-145258 | | 5/1994 |
| JP | 6-306384 | A | 11/1994 |
| JP | 7-048421 | | 2/1995 |
| JP | 7-062372 | | 3/1995 |
| JP | 8-183988 | A | 7/1996 |
| JP | 8-302378 | A | 11/1996 |
| JP | 9-003463 | | 1/1997 |
| JP | 2000-063439 | | 2/2000 |
| JP | 2000-63877 | | 2/2000 |
| JP | 2000-345170 | | 12/2000 |
| JP | 2000-345171 | | 12/2000 |
| JP | 2001-514301 | A | 9/2001 |
| JP | 2001-279278 | | 10/2001 |
| JP | 2001-279287 | A | 10/2001 |
| JP | 2002-503754 | | 2/2002 |
| JP | 2002-503755 | | 2/2002 |
| JP | 2002-129182 | A | 5/2002 |
| JP | 2002-521499 | | 7/2002 |
| JP | 2002-302687 | | 10/2002 |
| JP | 2004-10799 | | 1/2004 |
| JP | 2004-124080 | | 4/2004 |
| JP | 2004-169029 | | 6/2004 |
| JP | 2004-526831 | | 9/2004 |
| JP | 2004-528426 | | 9/2004 |
| JP | 2005-154760 | | 6/2005 |
| JP | 2005-171186 | A | 6/2005 |
| JP | 2005-213447 | | 8/2005 |
| JP | 2005-290238 | A | 10/2005 |
| JP | 2005-530902 | | 10/2005 |
| JP | 2006-502297 | | 1/2006 |
| JP | 2006-502298 | | 1/2006 |
| JP | 2006-045277 | | 2/2006 |
| JP | 2006-509899 | | 3/2006 |
| JP | 2006-117851 | | 5/2006 |
| JP | 2006-117853 | | 5/2006 |
| JP | 2006-219642 | | 8/2006 |
| JP | 2006-518395 | | 8/2006 |
| JP | 2006-241436 | | 9/2006 |
| JP | 2006-241437 | | 9/2006 |
| JP | 2006-521416 | | 9/2006 |
| JP | 2006-274209 | | 10/2006 |
| JP | 2007-016172 | | 1/2007 |
| JP | 2007-45850 | | 2/2007 |
| JP | 2007-217494 | | 8/2007 |
| JP | 2007-246659 | | 9/2007 |
| JP | 2007-246661 | | 9/2007 |
| JP | 2007-246662 | | 9/2007 |
| JP | 2007-262239 | | 10/2007 |
| JP | 2007-269885 | | 10/2007 |
| JP | 2007-270059 | | 10/2007 |
| JP | 2007-270062 | | 10/2007 |
| JP | 2007-284635 | | 11/2007 |
| JP | 2007-297528 | | 11/2007 |
| JP | 2007-326963 | | 12/2007 |
| JP | 2008-013281 | | 1/2008 |
| JP | 2008-13681 | | 1/2008 |
| JP | 2008-013684 | | 1/2008 |
| JP | 2008-509244 | | 3/2008 |
| JP | 2008-120908 | | 5/2008 |
| JP | 2008-120909 | | 5/2008 |
| JP | 2008-184569 | | 8/2008 |
| JP | 2008-231189 | | 10/2008 |
| JP | 2008-231190 | | 10/2008 |
| JP | 2008-231191 | | 10/2008 |
| JP | 2008-274236 | | 11/2008 |
| JP | 2008-274237 | | 11/2008 |
| JP | 2008-274238 | | 11/2008 |
| JP | 2008-303344 | | 12/2008 |
| JP | 2009-74068 | | 4/2009 |
| JP | 2009-96925 | A | 5/2009 |
| JP | 2009-167278 | | 7/2009 |
| JP | 2010-532805 | | 10/2010 |
| WO | 9603359 | | 2/1996 |
| WO | 99/41334 | | 8/1999 |
| WO | 02/070629 | | 9/2002 |

(56) References Cited

FOREIGN PATENT DOCUMENTS

| | | | |
|---|---|---|---|
| WO | 2005/037967 | | 4/2005 |
| WO | 2005/090528 | | 9/2005 |
| WO | 2006/043709 | | 4/2006 |
| WO | 2007/001000 | | 1/2007 |
| WO | 2007/105769 | | 9/2007 |
| WO | 2007/114132 | | 10/2007 |
| WO | 2007/114260 | | 10/2007 |
| WO | 2007/116759 | | 10/2007 |
| WO | 2007/119299 | | 10/2007 |
| WO | 2007/123266 | | 11/2007 |
| WO | 2007/133999 | | 11/2007 |
| WO | 2008/072526 | | 6/2008 |
| WO | 2008/093446 | | 8/2008 |
| WO | 2008/123246 | | 10/2008 |
| WO | 2008/123249 | | 10/2008 |
| WO | 2009/007147 | | 1/2009 |
| WO | 2009/072524 | | 6/2009 |
| WO | 2009/090921 | A1 | 7/2009 |
| WO | 2009/119505 | | 10/2009 |
| WO | 2010/041689 | | 4/2010 |
| WO | 2010/041692 | | 4/2010 |

OTHER PUBLICATIONS

International Search Report for PCT/JP2010/050921, Dated: Apr. 6, 2010.
International Preliminary Report on Patentability for PCT/JP2010/050921, Dated: Jun. 12, 2011.
Search Report issued with respect to European Patent Application No. 10783230.5, mailed Feb. 11, 2013.
Search Report issued with respect to European Patent Application No. 12008549.3, mailed Feb. 11, 2013.
Office Action issued with respect to U.S. Appl. No. 13/122,828, mailed Feb. 28, 2013.
Search Report issued with respect to European Patent Application No. 10783178.6, mailed Oct. 29, 2012.
English-language translation of International Preliminary Report on Patentability issued with respect to PCT/JP2009/055666, mailed Nov. 18, 2010.
English-language translation of International Preliminary Report on Patentability issued with respect to PCT/JP2009/055690, mailed Nov. 18, 2010.
Office Action issued with respect to Japanese Patent Application No. 2008-006024, mailed Dec. 4, 2012.
Office Action issued with respect to Chinese Patent Application No. 200980149130.9, mailed Dec. 4, 2012.
Office Action issued with respect to Chinese Patent Application No. 201080024425.6, mailed Dec. 12, 2012.
U.S. Appl. No. 13/392,189 to Akio Mutou et al., which was filed Feb. 24, 2012.
Hiroshi Ohtsuka et al., "Separation of Straight—Chain Hydrocarbons from Petroleum Fractions by Means of Urea—Adduct Formation", Bulletin of the Faculty of Engineering, Hokkaido University, 40, Mar. 30, 1966, pp. 125-137, along with a partial English-language translation.
Yozo Oshima et al., "Monomethylparaffins in n—Paraffins Adducted from Petroleum Fractions", Sekiyu Gakkaishi, vol. 18, No. 6, 1975, pp. 497-502, along with a partial English-language translation.
Notification of Information Provision issued with respect to Japanese Patent App. No. 2008-261079, mailed Mar. 12, 2013.
International Search report for PCT/JP2010/064698 (English and Japanese) , mailed Nov. 2, 2010.
English language version of International Preliminary Report on Patentability for PCT/JP2010/064698, mailed Mar. 29, 2012.
Office Action issued with respect to Chinese Patent Application No. 200980110123.8, mailed Apr. 1, 2013.
Schiessler et al., "Urea and Thiourea Adduction of $C_5$—$C_{42}$—Hydrocarbons", *Journal of the American Chemical Society,* vol. 74, No. 7, pp. 1720-1723, Apr. 5, 1952.
Notification of Information Provision issued with respect to Japanese Patent App. No. 2008-006024, mailed May 14, 2013.
"The Advent of Modern Hydroprocessing—The Evolution of Base Oil Technology—Part 2", Machinery Lubirication (Retrieved from: http://www.machinerylubrication.com/Read/493/base-oil-technology on May 14, 2012), May 1, 2003, XP55027093.
Search report from E.P.O. that issued with respect to European Patent Application No. 09819126.5, mailed May 23, 2012.
Search report from E.P.O. that issued with respect to European Patent Application No. 09819223.0, mailed May 23, 2012.
Notification of Information Provision issued with respect to Japanese Patent Application No. 2009-135369, mailed May 29, 2012.
Notification of Information Provision issued with respect to Japanese Patent Application No. 2009-135444, mailed Jun. 19, 2012.
E.P.O. Office action that issued with respect to European Patent Application No. 09723908.1, mailed Mar. 2, 2012.
English-language translation of International Preliminary Report on Patentability for PCT/JP2009/0067163, mailed May 26, 2011.
English-language translation of International Preliminary Report on Patentability for PCT/JP2009/055667, mailed Nov. 18, 2010.
English-language translation of International Preliminary Report on Patentability for PCT/JP2009/067504, mailed May 26, 2011.
English-language translation of International Preliminary Report on Patentability for PCT/JP2009/067509, mailed May 26, 2011.
English-language translation of International Preliminary Report on Patentability for PCT/JP2010/050916, mailed Jan. 26, 2012.
English-language translation of International Preliminary Report on Patentability for PCT/JP2010/057957, mailed Jan. 26, 2012.
English-language translation of International Preliminary Report on Patentability for PCT/JP2010/059196, mailed Jan. 26, 2012.
International Search Report for PCT/JP2009/067504, mailed Dec. 28, 2009.
International Search Report for PCT/JP2009/055667, mailed Jun. 16, 2009.
International Search Report for PCT/JP2010/050916, mailed Apr. 13, 2010.
International Search Report for PCT/JP2010/057957, mailed Aug. 17, 2010.
International Search Report for PCT/JP2010/059196, mailed Aug. 31, 2010.
J.P.O. Notification of Information Provision issued with respect to Japanese Patent Application No. 2008-078224, mailed May 15, 2012.
E.P.O. Search report issued with respect to European Patent Application No. 09723908.1, mailed Jun. 29, 2011.
Sharma et al., "Predicting Low Temperature Lubricant Rheology Using Nuclear Magnetic Resonance Spectroscopy and Mass Spectrometry", Tribology Letters, vol. 16, No. 1-2, Feb. 2004, pp. 11-19.
Shinya Sato et al., "Separation of n-Paraffin and 1-Olefin in Shale Oil by Urea Adduct Method", Sekiyu Gakkaishi, vol. 39, No. 5, 1996, pp. 365-368 with partial English language translation.
English-language translation of International Preliminary Report on Patentability for PCT/JP2009/050233, mailed Jul. 29, 2010.
J.P.O. Notification of Information Provision issued with respect to Japanese Patent Application No. 2008-261070, mailed Jun. 26, 2012.
E.P.O. Search Report issued with respect to European Patent Application No. 09819226.3, mailed Jun. 21, 2012.
J.P.O. Notification of Information Provision issued with respect to Japanese Patent Application No. 2008-078570, mailed May 22, 2012.
E.P.O. Search Report issued with respect to European Patent Application No. 09701700.8, mailed Jul. 5, 2012.
Search Report issued with respect to European Patent Application No. 12002743.8, mailed Aug. 16, 2012.
Search Report issued with respect to European Patent Application No. 12002744.6, mailed Aug. 16, 2012.
Office Action issued with respect to Indonesian Patent Application No. W00201003649, mailed Aug. 23, 2012.
Office Action issued with respect to U.S. Appl. No. 12/934,374, mailed Mar. 25, 2013.
Office Action issued with respect to U.S. Appl. No. 13/122,622, mailed Mar. 22, 2013.
Office Action issued with respect to U.S. Appl. No. 12/812,524, mailed Aug. 28, 2012.

(56) References Cited

OTHER PUBLICATIONS

Office Action issued with respect to Chinese Patent Application No. 200980110123.8, mailed Aug. 31, 2012.
Office Action issued with respect to Chinese Patent Application No. 200980110437.8, mailed Aug. 31, 2012.
Office Action issued with respect to European Patent Application No. 09723908.1, mailed Sep. 12, 2012.
Zimmerschied et al., "Crystalline Adducts of Urea with Linear Aliphatic Compounds", Industrial and Engineering Chemistry 42(7), Jul. 31, 1950, pp. 1300-1306.
Rowe et al., "Low-Temperature Performance Advantages for Oils Using Hydrodewaxed Base Stocks", SAE Technical Paper Series 831715, Jan. 1, 1983, pp. 1-14.
Speight, "Hydrocarbons from Petroleum", Handbook of Industrial Hydrocarbon Processes, Jan. 1, 2011, pp. 85-126.
Notification of Information Provision issued with respect to Japanese Patent Application No. 2008-261071, mailed Oct. 9, 2012.
Notification of Information Provision issued with respect to Japanese Patent Application No. 2008-261079, mailed Oct. 9, 2012.
Japanese Office Action issued with respect to Japanese Patent Appl. No. 2009-135369, dated Jul. 16, 2013.
Japanese Office Action issued with respect to Japanese Patent Application No. 2008-261079, dated May 21, 2013.
Japanese Office Action issued with respect to Japanese Patent Application No. 2008-261070, dated Jul. 2, 2013.

LUBRICANT OIL COMPOSITION

TECHNICAL FIELD

The present invention relates to a lubricant oil composition.

BACKGROUND ART

Lubricant oils are used for internal combustion engines, transmissions, and other machinery in order to smooth the action. Particularly, high performance is demanded of the lubricant oils for internal combustion engines (engine oils) along with higher performance and higher output of the internal combustion engines, and severer operation conditions, and the like. Accordingly, in order to satisfy such required performances, a variety of additives such as a wear-resistant agent, a metallic detergent, an ash-free dispersant, and an antioxidant are blended with the conventional engine oil (see Patent Literatures 1 to 3 below, for example.). Recently, a demand for fuel efficiency performance of the lubricant oil has been increased more and more, and use of a high viscosity index base oil or use of a variety of friction modifiers has been examined (see Patent Literature 4 below, for example.).

CITATION LIST

Patent Literature

[Patent Literature 1] Japanese Patent Application Laid-Open Publication No. 2001-279287

[Patent Literature 2] Japanese Patent Application Laid-Open Publication No. 2002-129182

[Patent Literature 3] Japanese Patent Application Laid-Open Publication No. 08-302378

[Patent Literature 4] Japanese Patent Application Laid-Open Publication No. 06-306384

SUMMARY OF INVENTION

Technical Problem

It cannot be said, however, that the conventional lubricant oil is sufficient from the viewpoint of fuel efficiency.

For example, as a conventional method for reducing fuel consumption, reduction in kinematic viscosity and improvement in a viscosity index of the lubricant oil (multi-grading by a combination of a low viscosity base oil with a viscosity index improver) are known. In this case, however, reduction in the viscosity of the lubricant oil or the base oil that forms the lubricant oil may cause the lubricating performance to be reduced under a severe lubricant condition (under a high temperature high shear condition), resulting in malfunctions such as wear, seizure, and fatigue breaking. Namely, in the conventional lubricant oil, it is difficult to give sufficient fuel efficiency while other practical performances such as durability are kept.

Moreover, in order to prevent the malfunctions above and give fuel efficiency while the durability is kept, it is effective that an HTHS viscosity at 150° C. ("HTHS viscosity" is also referred to as a "high temperature high shear viscosity.") is higher while a kinematic viscosity at 40° C., a kinematic viscosity at 100° C., and an HTHS viscosity at 100° C. are lower; however, it is very difficult for the conventional lubricant oil to satisfy all the requirements.

The present invention has been made in consideration of such a situation, and an object of the present invention is to provide a lubricant oil composition whose HTHS viscosity at 150° C. is sufficiently high, and kinematic viscosity at 40° C., kinematic viscosity at 100° C., and HTHS viscosity at 100° C. are sufficiently low.

Solution to Problem

In order to solve the problems, the present invention provides a lubricant oil composition comprising: a lubricant base oil whose kinematic viscosity at 100° C. is 1 to 6 $mm^2/s$, % $C_p$ is not less than 70, and % $C_A$ is not more than 2; a first viscosity index improver in which the ratio A/B of a viscosity increasing effect A of a kinematic viscosity at 100° C. represented by the following equation (1) to a viscosity increasing effect B of an HTHS viscosity at 150° C. represented by the following equation (2) when added to the lubricant base oil is a value of not less than 4.5 and a PSSI is not more than 30; and a second viscosity index improver in which the ratio A/B of the viscosity increasing effect A of the kinematic viscosity at 100° C. represented by the following equation (1) to the viscosity increasing effect B of the HTHS viscosity at 150° C. represented by the following equation (2) when added to the lubricant base oil is a value less than 4.5:

$$A=X-X_0 \quad (1)$$

wherein A represents a viscosity increasing effect of the kinematic viscosity at 100° C., X represents a kinematic viscosity at 100° C. (units: $mm^2/s$) of a mixture of the lubricant base oil with 3% by mass of the first or second viscosity index improver, and $X_0$ represents a kinematic viscosity at 100° C. (units: $mm^2/s$) of the lubricant base oil, $$B=Y-Y_0 \quad (2)$$

wherein B represents a viscosity increasing effect of the HTHS viscosity at 150° C., Y represents an HTHS viscosity at 150° C. (units: mPa·s) of a mixture of the lubricant base oil with 3% by mass of the first or second viscosity index improver, and $Y_0$ represents an HTHS viscosity at 150° C. (units: mPa·s) of the lubricant base oil.

The ratio (A/B) of the viscosity increasing effect A of the kinematic viscosity at 100° C. represented by the above equation (1) to the viscosity increasing effect B of the HTHS viscosity at 150° C. represented by the above equation (2) is an index indicating fuel efficiency under a shear condition in use (the number of rotation of the engine); it can be said that at a ratio of not less than 4.5, the viscosity index improver is the one whose fuel efficiency ability in the high shear range is high but the fuel efficiency ability in the low shear range is poor. On the other hand, it can be said that at a ratio less than 4.5, the viscosity index improver is the one whose fuel efficiency ability in the low shear range is high but the fuel efficiency ability in the high shear range is poor.

By use of a viscosity index improver with the A/B of not less than 4.5 and a viscosity index improver with the AB less than 4.5 in combination, the fuel efficiency in the high shear range and that in the low shear range can be obtained at the same time.

The "kinematic viscosity at 100° C." in the present invention refers to the kinematic viscosity at 100° C. specified in ASTM D-445. The "% $C_p$" and "% $C_A$" mean a percentage of the number of carbon atoms in paraffin based on the number of the whole carbon atoms and a percentage of the number of carbon atoms in aromatic rings based on the number of the whole carbon atoms, respectively, determined by a method according to ASTM D 3238-85 (n-d-M ring analysis). The "HTHS viscosity at 150° C." means the high temperature high shear viscosity at 150° C. specified by ASTM D4683. The "PSSI" means the permanent shear stability index (Permanent Shear Stability Index) of a polymer calculated based on the data measured by ASTM D 6278-02 (Test Method for Shear Stability of Polymer Containing Fluids Using a European Diesel Injector Apparatus) according to ASTM D 6022-01 (Standard Practice for Calculation of Permanent Shear Stability Index).

It is preferable that the second viscosity index improver used in the present invention is polymethacrylate in which the PSSI is not more than 30.

Advantageous Effects of Invention

As described above, according to the present invention, a lubricant oil composition is provided in which the HTHS viscosity at 150° C. is sufficiently high, and the kinematic viscosity at 40° C., kinematic viscosity at 100° C., and HTHS viscosity at 100° C. are sufficiently low. For example, according to the lubricant oil composition of the present invention, without using a synthetic oil such as a poly-α-olefin base oil or an ester base oil or a low viscosity mineral oil base oil, sufficient fuel efficiency can be demonstrated while the HTHS viscosity at 150° C. is kept at a desired value (not less than 2.9 mPa·s in the case of oils whose SAE viscosity grade is 0W-30 or 5W-30).

DESCRIPTION OF EMBODIMENTS

Hereinafter, a suitable embodiment of the present invention will be described in detail.

In the lubricant oil composition according to the present embodiment, a lubricant base oil whose kinematic viscosity at 100° C. is 1 to 6 $mm^2/s$, % $C_p$ is not less than 70, and % $C_A$ is not more than 2 (hereinafter, referred to as a "lubricant base oil according to the present embodiment") is used.

The lubricant base oil according to the present embodiment is not particularly limited as long as the kinematic viscosity at 100° C., % $C_p$ and % $C_A$ satisfy the condition. Specifically, of paraffin mineral oils obtained by refining a lubricant oil fraction obtained by normal pressure distillation and/or reduced pressure distillation of a crude oil by one or two or more of refining treatments selected from solvent deasphalting, solvent extraction, hydrocracking, solvent dewaxing, catalytic dewaxing, hydrorefining, sulfuric acid washing, and clay treatment, or normal paraffin base oils, isoparaffin base oils, and the like, base oils whose kinematic viscosity at 100° C., % $C_p$ and % $C_A$ satisfy the condition described above can be used.

Preferable examples of the lubricant base oil according to the present embodiment can include base oils obtained by using base oils (1) to (8) shown below as a raw material, refining the raw material oil and/or a lubricant oil fraction recovered from the raw material oil by a predetermined refining method, and recovering a lubricant oil fraction:

(1) a distilled oil obtained by normal pressure distillation of a paraffin-base crude oil and/or a mixed-base crude oil,
(2) a distilled oil obtained by reduced pressure distillation of a residue of a paraffin-base crude oil and/or a mixed-base crude oil subjected to normal pressure distillation (WVGO),
(3) a wax obtained by a lubricant oil dewaxing step (such as slack wax) and/or a synthetic wax obtained by a gas-to-liquid (GTL) process or the like (such as Fischer-Tropsch wax and GTL wax),
(4) one selected from the base oils (1) to (3) or a mixed oil of two or more selected from the base oils (1) to (3) and/or a mild hydrocracked oil of the mixed oil,
(5) a mixed oil of two or more selected from the base oils (1) to (4),
(6) a deasphalted oil of the base oil (1), (2), (3), (4), or (5) (DAO),
(7) a mild hydrocracked oil of the base oil (6) (MHC), and
(8) a mixed oil of two or more selected from the base oils (1) to (7).

As the predetermined refining method, hydrorefining such as hydrocracking and hydrofinishing; solvent refining such as furfural solvent extraction; dewaxing such as solvent dewaxing and catalytic dewaxing; clay refining using acid clay, activated clay, or the like; and chemical (acid or alkali) washing such as sulfuric acid washing and sodium hydroxide washing are preferable. In the present embodiment, one of these refining methods may be performed alone, or two or more thereof may be performed in combination. In the case where two or more of the refining methods are combined, the order is not particularly limited, and can be properly determined.

Further, as the lubricant base oil according to the present embodiment, a base oil (9) or (10) below obtained by performing a predetermined treatment on the base oil selected from the base oils (1) to (8) or a lubricant oil fraction recovered from the base oil is particularly preferable:

(9) a hydrocracked mineral oil obtained by hydrocracking the base oil selected from the base oils (1) to (8) or a lubricant oil fraction recovered from the base oil, performing a dewaxing treatment such as solvent dewaxing and catalytic dewaxing on the product or a lubricant oil fraction recovered from the product by distillation or the like, or performing the dewaxing treatment and distilling the dewaxed product; or
(10) a hydrogenation isomerized mineral oil obtained by hydrogenation isomerizing the base oil selected from the base oils (1) to (8) or a lubricant oil fraction recovered from the base oil, performing a dewaxing treatment such as solvent dewaxing and catalytic dewaxing on the product or a lubricant oil fraction recovered from the product by distillation or the like, or performing the dewaxing treatment and distilling the dewaxed product.

The kinematic viscosity at 100° C. of the lubricant base oil according to the present embodiment needs to be not more than 6 $mm^2/s$, preferably not more than 5.7 $mm^2/s$, more preferably not more than 5.5 $mm^2/s$, still more preferably not more than 5.2 $mm^2/s$, particularly preferably not more than 5.0 $mm^2/s$, and most preferably not more than 4.5 $mm^2/s$. On the other hand, the kinematic viscosity at 100° C. needs to be not less than 1 $mm^2/s$, and is preferably not less than 1.5 $mm^2/s$, more preferably not less than 2 $mm^2/s$, still more preferably not less than 2.5 $mm^2/5$, particularly preferably not less than 3 $mm^2/s$, and most preferably not less than 3.5 $mm^2/s$. In the case where the kinematic viscosity at 100° C. of the lubricant base oil is more than 6 $mm^2/s$, the low temperature viscosity properties may be reduced, and sufficient fuel efficiency may not be obtained; at a kinematic viscosity at 100° C. of not more than 1 $mm^2/s$, lubricating properties may be poor because oil film formation in a lubricated place is insufficient, and evaporation loss of the lubricant oil composition may be increased.

The kinematic viscosity at 40° C. of the lubricant base oil according to the present embodiment is preferably not more than 50 $mm^2/s$, more preferably not more than 45 $mm^2/s$, still more preferably not more than 40 $mm^2/s$, particularly preferably not more than 35 $mm^2/s$, and most preferably not more than 30 $mm^2/s$. On the other hand, the kinematic viscosity at 40° C. is preferably not less than 6.0 $mm^2/s$, more preferably not less than 8.0 $mm^2/s$, still more preferably not less than 12

$mm^2/s$, particularly preferably not less than 14 $mm^2/s$, and most preferably not less than 15 $mm^2/s$. In the case where the kinematic viscosity at 40° C. of the lubricant base oil is more than 50 $mm^2/s$, the low temperature viscosity properties may be reduced, and sufficient fuel efficiency may not be obtained; at a kinematic viscosity at 40° C. not more than 6.0 $mm^2/s$, the lubricating properties may be poor because oil film formation in a lubricated place is insufficient, and evaporation loss of the lubricant oil composition may be increased. In the present embodiment, it is also preferable that the lubricant oil fraction whose kinematic viscosity at 40° C. is within the range below be fractionated by distillation or the like, and used.

The viscosity index of the lubricant base oil according to the present embodiment is preferably not less than 120, more preferably not less than 130, still more preferably not less than 135, and particularly preferably not less than 140. At a viscosity index less than the lower limit, the viscosity-temperature properties, heat and oxidation stabilities, and anti-volatilization tend to be reduced, a coefficient of friction tends to be increased, and wear resistance tends to be reduced.

The viscosity index in the present invention means a viscosity index measured according to JIS K 2283-1993.

While the density at 15° C. ($\rho_{15}$) of the lubricant base oil according to the present embodiment depends on the viscosity grade of the lubricant base oil, it is preferable that the density at 15° C. be not more than a value p represented by the following equation (3), namely, $\rho_{15} \leq \rho$:

$$\rho = 0.0025 \times X_0 + 0.816 \quad (3)$$

wherein $X_0$ represents the kinematic viscosity at 100° C. of the lubricant base oil ($mm^2/s$).

If $\rho_{15} > \rho$, the viscosity-temperature properties, heat and oxidation stabilities, anti-volatilization, and low temperature viscosity properties tend to be reduced, and the fuel efficiency may be reduced. In the case where an additive is blended with the lubricant base oil, the effect of the additive may be reduced.

Specifically, the density at 15° C. ($\rho_{15}$) of the lubricant base oil according to the present embodiment is preferably not more than 0.860, more preferably not more than 0.850, still more preferably not more than 0.840, and particularly preferably not more than 0.822.

The density at 15° C. in the present invention means the density measured at 15° C. according to JIS K 2249-1995.

The pour point of the lubricant base oil according to the present embodiment depends on the viscosity grade of the lubricant base oil, and for example, the pour point of the lubricant base oils (I) and (IV) is preferably not more than −10° C., more preferably not more than −12.5° C., and still more preferably not more than −15° C. The pour point of the lubricant base oils (II) and (V) is preferably not more than −10° C., more preferably not more than −15° C., and still more preferably not more than −17.5° C. The pour point of the lubricant base oils (III) and (VI) is preferably not more than −10° C., more preferably not more than −12.5° C., and still more preferably not more than −15° C. At a pour point more than the upper limit, the low temperature fluidity of the whole lubricant oil using the lubricant base oil tends to be reduced. The pour point in the present invention means the pour point measured according to JIS K 2269-1987.

The aniline point (AP (° C.)) of the lubricant base oil according to the present embodiment depends on the viscosity grade of the lubricant base oil, and it is preferable that the aniline point be not less than a value $AP_0$ represented by the following equation (4), namely, $AP \geq AP_0$:

$$AP_0 = 4.3 \times X_0 + 100 \quad (4)$$

wherein $X_0$ represents the kinematic viscosity at 100° C. of the lubricant base oil ($mm^2/s$).

If $AP < AP_0$, the viscosity-temperature properties, heat and oxidation stabilities, anti-volatilization, and low temperature viscosity properties tend to be reduced; in the case where an additive is blended with the lubricant base oil, the effect of the additive tends to be reduced.

For example, the AP of the lubricant base oils (I) and (IV) is preferably not less than 108° C., and more preferably not less than 110° C. The AP of the lubricant base oils (II) and (V) is preferably not less than 113° C., and more preferably not less than 119° C. The AP of the lubricant base oils (III) and (VI) is preferably not less than 125° C., and more preferably not less than 128° C. The aniline point of the present invention means the aniline point measured according to JIS K 2256-1985.

The iodine number of the lubricant base oil according to the present embodiment is preferably not more than 3, more preferably not more than 2, still more preferably not more than 1, particularly preferably not more than 0.9, and most preferably not more than 0.8. The iodine number may be less than 0.01, but because the effect worth to the iodine number is small and because of cost efficiency, the iodine number is preferably not less than 0.001, more preferably not less than 0.01, still more preferably not less than 0.03, and particularly preferably not less than 0.05. At an iodine number of the lubricant base oil not more than 3, heat and oxidation stabilities can be significantly improved. The iodine number of the present invention means the iodine number measured according to JIS K 0070 by a method for titrating an indicator, "The acid value, saponification value, iodine number, hydroxyl value, and non-saponification value of chemical products."

The amount of the sulfur content in the lubricant base oil according to the present embodiment depends on the sulfur content of the raw material. For example, in the case where a raw material substantially containing no sulfur such as a synthetic wax component obtained by the Fischer-Tropsch reaction or the like is used, the lubricant base oil substantially containing no sulfur can be obtained. In the case where a raw material containing sulfur such as a slack wax obtained by a refining process of the lubricant base oil and a microcrystalline wax obtained by a wax refining process is used, the sulfur content in the lubricant base oil to be obtained is usually not less than 100 mass ppm. In the lubricant base oil according to the present embodiment, from the viewpoint of further improvement in heat and oxidation stabilities and reduction of sulfur, the sulfur content is preferably not more than 100 mass ppm, more preferably not more than 50 mass ppm, still more preferably not more than 10 mass ppm, and particularly preferably not more than 5 mass ppm.

The amount of the nitrogen content in the lubricant base oil according to the present embodiment is not particularly limited, and is preferably not more than 7 mass ppm, more preferably not more than 5 mass ppm, and still more preferably not more than 3 mass ppm. At a nitrogen content more than 5 mass ppm, the heat and oxidation stabilities tend to be reduced. The nitrogen content of the present invention means the nitrogen content measured according to JIS K 2609-1990.

The % $C_p$ of the lubricant base oil according to the present embodiment needs to be not less than 70, preferably not less than 80, more preferably not less than 85, still more preferably not less than 87, and particularly preferably not less than 90. The % $C_p$ of the lubricant base oil is preferably not more than 99, more preferably not more than 96, still more preferably not more than 95, and particularly preferably not more than 94. In the case where the % $C_p$ of the lubricant base oil is less than the lower limit, the viscosity-temperature properties, and heat and oxidation stabilities tend to be reduced; further, in the case where an additive is blended with the lubricant base oil, the effect of the additive tends to be reduced. If the % $C_p$ of the lubricant base oil is more than the upper limit, the low temperature fluidity tends to be reduced and the solubility of the additive tends to be reduced.

The % $C_A$ of the lubricant base oil according to the present embodiment needs to be not more than 2, more preferably not more than 1.5, still more preferably not more than 1, particularly preferably not more than 0.8 and most preferably not more than 0.5. If the % $C_A$ of the lubricant base oil is more than the upper limit, the viscosity-temperature properties, and heat and oxidation stabilities tend to be reduced.

The % $C_N$ of the lubricant base oil according to the present embodiment is preferably not more than 30, more preferably 4 to 25, still more preferably 5 to 13, and particularly preferably 5 to 8. If the % $C_N$ of the lubricant base oil is more than the upper limit, the viscosity-temperature properties, heat and oxidation stabilities, and friction properties tend to be reduced. If the % $C_N$ is less than the lower limit, the solubility of the additive tends to be reduced. The "% $C_N$" in the present invention means a percentage of the number of carbon atoms in naphthene based on the number of the whole carbon atoms determined by a method according to ASTM D 3238-85 (n-d-M ring analysis).

The amount of the saturated content in the lubricant base oil according to the present embodiment is not particularly limited as long as the kinematic viscosity at 100° C., and % $C_p$ and % $C_A$ satisfy the condition described above, and is preferably not less than 90% by mass, preferably not less than 95% by mass, and more preferably not less than 99% by mass based on the whole amount of the lubricant base oil; the proportion of the cyclic saturated content in the saturated content is preferably not more than 40% by mass, preferably not more than 35% by mass, preferably not more than 30% by mass, more preferably not more than 25% by mass, and still more preferably not more than 21% by mass. The proportion of the cyclic saturated content in the saturated content is preferably not less than 5% by mass, and more preferably not less than 10% by mass. If the proportion of the saturated content and that of the cyclic saturated content in the saturated content each satisfy the conditions described above, the viscosity-temperature properties and the heat and oxidation stabilities can be improved; in the case where an additive is blended with the lubricant base oil, the additive can sufficiently stably be dissolved and kept in the lubricant base oil to demonstrate the function of the additive at a higher level. Further, according to the present embodiment, the friction properties of the lubricant base oil itself can be improved; as a result, improvement in reduction in friction and reduction in energy can be achieved.

The saturated content in the present invention is measured by the method according to ASTM D 2007-93.

The aromatic content of the lubricant base oil according to the present embodiment is not particularly limited as long as the kinematic viscosity at 100, % $C_p$ and % $C_A$ satisfy the condition described above; the aromatic content is preferably not more than 5% by mass, more preferably not more than 4% by mass, still more preferably not more than 3% by mass, and particularly preferably not more than 2% by mass, and preferably not less than 0.1% by mass, more preferably not less than 0.5% by mass, still more preferably not less than 1% by mass, and particularly preferably not less than 1.5% by mass based on the whole amount of the lubricant base oil. At an amount of the aromatic content more than the upper limit, the viscosity-temperature properties, heat and oxidation stabilities, friction properties, anti-volatilization properties, and low temperature viscosity properties tend to be reduced; further, in the case where an additive is blended with the lubricant base oil, the effect of the additive tends to be reduced. While the lubricant base oil according to the present embodiment may be those containing no aromatic content, at an amount of the aromatic content not less than the lower limit, the solubility of the additive can be further enhanced.

The aromatic content in the present invention means a value measured according to ASTM D 2007-93.

In the lubricant oil composition according to the present embodiment, the lubricant base oil according to the present embodiment may be used alone, or the lubricant base oil according to the present embodiment may be used in combination with other one or two or more lubricant base oils. In the case where the lubricant base oil according to the present embodiment is used in combination with other lubricant base oil, the proportion of the lubricant base oil according to the present embodiment in the mixed base oils is preferably not less than 30% by mass, more preferably not less than 50% by mass, and still more preferably not less than 70% by mass.

The other lubricant base oil used in combination with the lubricant base oil according to the present embodiment is not particularly limited, and examples of mineral base oils include solvent refined mineral oils, hydrocracked mineral oils, hydrorefined mineral oils, solvent dewaxed base oils in which the kinematic viscosity at 100° C. is 1 to 100 $mm^2/s$, and the % $C_p$ and % $C_A$ do not satisfy the conditions described above.

Examples of synthetic base oils include poly-α-olefins or hydrogenated products thereof, isobutene oligomers or hydrogenated products thereof, isoparaffin, alkylbenzenes, alkylnaphthalenes, diesters (such as ditridecylglutarate, di-2-ethylhexyladipate, diisodecyladipate, ditridecyladipate, and di-2-ethylhexylsebacate), polyol esters (such as trimethylolpropanecaprylate, trimethylolpropanepelargonate, pentaerythritol-2-ethylhexanoate, and pentaerythritolpelargonate), polyoxyalkylene glycol, dialkyldiphenyl ethers, polyphenyl ethers in which the kinematic viscosity at 100° C. does not satisfy the condition described above; among them, poly-α-olefins are preferable. Examples of poly-α-olefins include oligomers or co-oligomers of α-olefins with typically 2 to 32 carbon atoms, and preferably 6 to 16 carbon atoms (such as 1-octene oligomers, decene oligomers, and ethylene-propylene co-oligomer) and hydrogenated products thereof.

In addition to the lubricant base oil according to the present embodiment, the lubricant oil composition according to the present embodiment comprises a first viscosity index improver in which the ratio A/B of the viscosity increasing effect A of the kinematic viscosity at 100° C. represented by the following equation (1) to the viscosity increasing effect B of the HTHS viscosity at 150° C. represented by the following equation (2) is a value of not less than 4.5, and the PSSI is not more than 30; and a second viscosity index improver in which the ratio A/B of the viscosity increasing effect A of the kinematic viscosity at 100° C. represented by the following equation (1) to the viscosity increasing effect B of the HTHS viscosity at 150° C. represented by the following equation (2) when added to the lubricant base oil is a value less than 4.5:

$$A=X-X_0 \quad (1)$$

wherein A represents a viscosity increasing effect of the kinematic viscosity at 100° C., X represents a kinematic viscosity at 100° C. (units: $mm^2/s$) of a mixture of the lubricant base oil with 3% by mass of the first or second viscosity index improver, $X_0$ represents a kinematic viscosity (units: $mm^2/s$) at 100° C. of the lubricant base oil, $$B=Y-Y_0 \quad (2)$$

wherein B represents a viscosity increasing effect of the HTHS viscosity at 150° C., Y represents an HTHS viscosity at 150° C. (units: mPa·s) of a mixture of the lubricant base oil with 3% by mass of the first or second viscosity index improver, and $Y_0$ represents an HTHS viscosity at 150° C. (units: mPa·s) of the lubricant base oil.

The viscosity increasing effects A and B of the first and second viscosity index improvers can be determined as follows: each of the kinematic viscosities at 100° C. $X_0$ and X and each of the HTHS viscosities at 150° C. $Y_0$ and Y before and after a predetermined amount (for example, 3% by mass) of the viscosity index improver is added to the lubricant base oil according to the present embodiment are measured, and the difference $X-X_0$ or $Y-Y_0$ is calculated.

As described above, the ratio A/B of the viscosity increasing effect of the first viscosity index improver needs to be not less than 4.5, and is preferably not less than 4.6, more preferably 4.8, and most preferably not less than 5.0.

The PSSI (permanent shear stability index) of the first viscosity index improver needs to be not more than 30, and is preferably not more than 20, more preferably not more than 10, still more preferably not more than 8, and particularly preferably not more than 6. The lower limit of the PSSI of the viscosity index improver (A) is preferably not less than 1, and more preferably not less than 3. At a PSSI more than 30, the shear stability is reduced; therefore, an initial kinematic viscosity needs to be increased, and the fuel efficiency may be reduced. At a PSSI less than 1, an effect of improving the viscosity index when the first viscosity index improver is dissolved in the lubricant base oil is small, the fuel efficiency and low temperature viscosity properties are poor, and cost may be increased.

As described above, the ratio A/B of the viscosity increasing effect of the second viscosity index improver needs to be less than 4.5, and is preferably not more than 4.0, more preferably not more than 3.8, and particularly preferably not more than 3.5.

The upper limit of the PSSI of the second viscosity index improver is preferably not more than 50, more preferably not more than 40, still more preferably not more than 30, particularly preferably not more than 20, and most preferably not more than 10. The lower limit of the PSSI of the second viscosity index improver is preferably not less than 1, and more preferably not less than 3. At a PSSI more than 50, the shear stability is reduced; therefore, an initial kinematic viscosity needs to be increased, and the fuel efficiency may be reduced. At a PSSI less than 1, an effect of improving the viscosity index when the second viscosity index improver is dissolved in the lubricant base oil is small, the fuel efficiency and low temperature viscosity properties are poor, and cost may be increased.

In each of the first and second viscosity index improvers, the ratio ($M_W$/PSSI) of the weight-average molecular weight to the PSSI is preferably not less than $0.3\times10^4$, more preferably not less than $0.5\times10^4$, still more preferably not less than $0.7\times10^4$, and particularly preferably not less than $1\times10^4$. At an $M_W$/PSSI less than $0.3\times10^4$, the fuel efficiency, low temperature starting properties, i.e., viscosity temperature properties, and low temperature viscosity properties may be reduced.

In each of the first and second viscosity index improvers, the ratio ($M_W/M_N$) of the weight-average molecular weight ($M_W$) to the number-average molecular weight ($M_N$) is preferably not more than 5.0, more preferably not more than 4.0, still more preferably not more than 3.5, and particularly preferably not more than 3.0. The $M_W/M_N$ is preferably not less than 1.0, more preferably not less than 2.0, still more preferably not less than 2.5, and particularly preferably not less than 2.6. At an $M_W/M_N$ not less than 4.0 or not more than 1.0, the solubility and an effect of improving the viscosity temperature properties are reduced, and sufficient storing stability and fuel efficiency may not be kept.

The first viscosity index improver is not particularly limited as long as the ratio AB of the viscosity increasing effect and PSSI satisfy the conditions described above. For example, among non-dispersion type or dispersion type poly (meth)acrylates, styrene-diene hydrogenated copolymers, non-dispersion type or dispersion type ethylene-α-olefin copolymers or hydrogenated products thereof, polyisobutylene or hydrogenated products thereof, styrene-maleic anhydride ester copolymers, and polyalkylstyrenes and (meth) acrylate-olefin copolymers or a mixture of these, examples of the first viscosity index improver include those in which the ratio A/B and PSSI of the viscosity increasing effect satisfy the conditions described above.

The second viscosity index improver is not particularly limited as long as the ratio A/B of the viscosity increasing effect satisfy the conditions described above. For example, among non-dispersion type or dispersion type poly(meth) acrylates, styrene-diene hydrogenated copolymers, non-dispersion type or dispersion type ethylene-α-olefin copolymers or hydrogenated products thereof, polyisobutylenes or hydrogenated products thereof, styrene-maleic anhydride ester copolymers, and polyalkylstyrenes and (meth)acrylate-olefin copolymers or a mixture of these, examples of the second viscosity index improver include those in which the ratio A/B of the viscosity increasing effect satisfy the conditions described above.

The poly(meth)acrylate compound (poly(meth)acrylate compound here refers to polyacrylate compounds and polymethacrylate compounds inclusively) used as the first and second viscosity index improvers is preferably a polymer of a polymerizable monomer containing (meth)acrylate monomer represented by the following formula (5) (hereinafter, referred to as "Monomer M-1"):

[Chemical Formula 1]

(5)

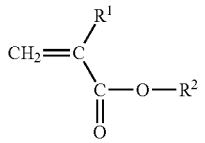

wherein $R^1$ represents hydrogen or a methyl group, and $R^2$ represents a linear or branched hydrocarbon group with 1 to 200 carbon atoms.

While one homopolymer of the monomer represented by the formula (5) or two or more poly(meth)acrylate compounds obtained by copolymerization are the so-called non-dispersion type poly(meth)acrylate, the poly(meth)acrylate compound according to the present embodiment may be a dispersion type poly(meth)acrylate obtained by copolymerization of the monomer represented by the formula (5) with one or more monomers selected from the following formulas (6) and (7) (hereinafter, referred to as "Monomer M-2" and "Monomer M-3," respectively):

[Chemical Formula 2]

(6)

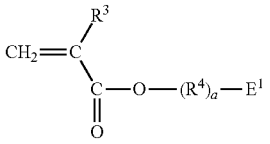

wherein $R^3$ represents a hydrogen atom or a methyl group, and $R^4$ represents an alkylene group with 1 to 18 carbon atoms, $E^1$ represents an amine residue or heterocyclic residue with 1 to 2 nitrogen atoms and 0 to 2 oxygen atoms, and a represents 0 or 1;

[Chemical Formula 3]

(7)

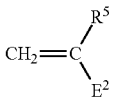

wherein $R^5$ represents a hydrogen atom or a methyl group, $E^2$ represents an amine residue or heterocyclic residue with 1 to 2 nitrogen atoms and 0 to 2 oxygen atoms.

Examples of the group represented by $E^1$ and $E^2$ can specifically include a dimethyl amino group, a diethylamino group, a dipropylamino group, a dibutylamino group, an anilino group, a toluidino group, a xylidino group, an acetylamino group, a benzoylamino group, a morpholino group, a pyrrolyl group, a pyrrolino group, a pyridyl group, a methylpyridyl group, a pyrrolidinyl group, a piperidinyl group, a quinonyl group, a pyrrolidonyl group, a pyrrolidono group, an imidazolino group, and a pyrazino group.

Preferable examples of Monomer M-2 and Monomer M-3 can specifically include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and a mixture thereof.

The copolymerization molar ratio of Monomer M-1 to Monomers M-2 and M-3 in the copolymer is not particularly limited, and preferably approximately M-1:M-2 and M-3=99:1 to 80:20, more preferably 98:2 to 85:15, and still more preferably 95:5 to 90:10.

The weight-average molecular weight ($M_W$) of the poly (meth)acrylate compound is preferably not less than 5,000, more preferably not less than 10,000, still more preferably not less than 20,000, and particularly preferably not less than 50,000. The weight-average molecular weight is preferably not more than 700,000, more preferably not more than 500,000, still more preferably not more than 200,000, and particularly preferably not more than 100,000. At a weight-average molecular weight less than 5,000, the effect of improving the viscosity index when the viscosity index improver is dissolved in the lubricant base oil is small, the fuel efficiency and low temperature viscosity properties are poor, and cost may be increased; at a weight-average molecular weight more than 1,000,000, the shear stability, solubility in the lubricant base oil, and storing stability may be reduced.

The styrene-diene hydrogenated copolymer that can be used as the first and second viscosity index improvers is a compound obtained by hydrogenation of a copolymer of styrene and diene. As diene, specifically, butadiene, isoprene, and the like are used. Particularly, it is preferably a hydrogenated copolymer of styrene and isoprene.

The weight-average molecular weight ($M_W$) of the styrene-diene hydrogenated copolymer is preferably not less than 5,000, more preferably not less than 10,000, and still more preferably not less than 15,000. The weight-average molecular weight ($M_W$) is preferably not more than 100,000, more preferably not more than 80,000, and still more preferably not more than 70,000. At a weight-average molecular weight less than 5,000, the effect of improving the viscosity index when the viscosity index improver is dissolved in the lubricant base oil is small, the fuel efficiency and low temperature viscosity properties are poor, and cost may be increased; at a weight-average molecular weight more than 100,000, the shear stability, solubility of the lubricant base oil, and storing stability may be reduced.

The ethylene-α-olefin copolymers or hydrogenated products thereof that can be used as the first and second viscosity index improvers is a copolymer of ethylene and α-olefin or a compound obtained by hydrogenation of the copolymer. As α-olefin, specifically, propylene, isobutylene, 1-butene, 1-pentene, 1-hexene, 1-octene, 1-decene, 1-dodecene, and the like are used. As the ethylene-α-olefin copolymer, the so-called non-dispersion type ethylene-α-olefin copolymer comprising only hydrocarbons, and the so-called dispersion type ethylene-α-olefin copolymer obtained by reacting a polar compound such as a nitrogen containing compound with a copolymer can be used.

The weight-average molecular weight ($M_W$) of the ethylene-α-olefin copolymer or hydrogenated products thereof is preferably not less than 5,000, more preferably not less than 10,000, and still more preferably not less than 30,000. The weight-average molecular weight ($M_W$) is preferably not more than 500,000, more preferably not more than 400,000, and still more preferably not more than 300,000. At a weight-average molecular weight less than 5,000, the effect of improving the viscosity index when the viscosity index improver is dissolved in the lubricant base oil is small, the fuel efficiency and low temperature viscosity properties are poor, and cost may be increased; at a weight-average molecular weight more than 500,000, the shear stability, solubility in the lubricant base oil, and storing stability may be reduced.

In the lubricant oil composition according to the present embodiment, the first viscosity index improver is preferably a styrene-diene hydrogenated copolymer in which the ratio A/B of the viscosity increasing effect is not less than 4.6, more preferably a styrene-diene hydrogenated copolymer in which the ratio A/B of the viscosity increasing effect is 4.8, and most preferably a styrene-diene hydrogenated copolymer in which the ratio A/B of the viscosity increasing effect is not less than 5.0.

Moreover, in the lubricant oil composition according to the present embodiment, the second viscosity index improver is preferably poly(meth)acrylate in which the ratio A/B of the viscosity increasing effect is less than 4.0, more preferably poly(meth)acrylate in which the ratio A/B of the viscosity increasing effect is not more than 3.8, and particularly preferably poly(meth)acrylate in which the ratio A/B of the viscosity increasing effect is not more than 3.5.

Further, in the lubricant oil composition according to the present embodiment, most preferably, the styrene-diene hydrogenated copolymer in which the ratio A/B of the viscosity increasing effect is not less than 4.5 as the first viscosity index improver is used in combination with poly(meth)acrylate in which the ratio A/B of the viscosity increasing effect is less than 4.5 as the second viscosity index improver.

The content of the first viscosity index improver in the lubricant oil composition according to the present embodiment is 0.1 to 15.0% by mass, preferably 0.5 to 13.0% by mass, more preferably 1.0 to 12.0% by mass, and still more preferably 1.5 to 10.0% by mass based on the whole amount of the composition. At a content less than 0.1% by mass, the low temperature properties may be insufficient; at a content more than 15.0% by mass, the shear stability of the composition may be reduced.

The content of the second viscosity index improver in the lubricant oil composition according to the present embodiment is 0.1 to 10.0% by mass, preferably 0.5 to 9.0% by mass, more preferably 1.0 to 8.0% by mass, and still more preferably 1.5 to 7.0% by mass based on the whole amount of the composition. At a content less than 0.1% by mass, the low temperature properties may be insufficient; at a content more than 10.0% by mass, the shear stability of the composition may be reduced.

In the lubricant oil composition according to the present embodiment, in order to enhance the fuel efficiency ability, friction modifiers selected from organic molybdenum compounds and ash-free friction modifiers can be further contained.

Examples of the organic molybdenum compound used in the present embodiment include organic molybdenum compounds containing sulfur such as molybdenum dithiophosphate and molybdenum dithiocarbamate.

In the lubricant oil composition according to the present embodiment, in the case where the organic molybdenum compound is used, the content is not particularly limited; the content is preferably not less than 0.001% by mass, more preferably not less than 0.005% by mass, still more preferably not less than 0.01% by mass, and particularly preferably not less than 0.02% by mass, and preferably not more than 0.2% by mass, more preferably not more than 0.1% by mass, still more preferably not more than 0.07% by mass, and particularly preferably not more than 0.05% by mass based on the whole amount of the composition in terms of the molybdenum element. At a content less than 0.001% by mass, the heat and oxidation stabilities of the lubricant oil composition are insufficient, and particularly, high detergency tends not to be kept for a long period of time. On the other hand, at a content more than 0.2% by mass, the effect proportional to the content cannot be obtained, and the storing stability of the lubricant oil composition tends to be reduced.

As the ash-free friction modifiers used in the present embodiment, any compound usually used for the friction modifier for the lubricant oil can be used, and examples thereof include ash-free friction modifiers such as amine compounds, fatty acid esters, fatty acid amides, fatty acids, aliphatic alcohols, and aliphatic ethers having at least one alkyl group or alkenyl group with 6 to 30 carbon atoms, particularly linear alkyl group or linear alkenyl group with 6 to 30 carbon atoms in the molecule. Examples thereof also include one or more compounds selected from the group consisting of the nitrogen containing compounds and acid modified derivatives thereof represented by the following formulas (8) and (9) and a variety of ash-free friction modifiers exemplified in WO 2005/037967.

[Chemical Formula 4]

(8)

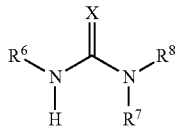

wherein $R^6$ is a hydrocarbon group with 1 to 30 carbon atoms or a hydrocarbon group with 1 to 30 carbon atoms having functionality, preferably a hydrocarbon group with 10 to 30 carbon atoms or a hydrocarbon group with 10 to 30 carbon atoms having functionality, more preferably an alkyl group with 12 to 20 carbon atoms, an alkenyl group with 12 to 20 carbon atoms, or a hydrocarbon group with 12 to 20 carbon atoms having functionality, and particularly preferably an alkenyl group with 12 to 20 carbon atoms; $R^7$ and $R^8$ each individually are a hydrocarbon group with 1 to 30 carbon atoms, a hydrocarbon group with 1 to 30 carbon atoms having functionality or hydrogen, preferably a hydrocarbon group with 1 to 10 carbon atoms, a hydrocarbon group with 1 to 10 carbon atoms having functionality or hydrogen, more preferably a hydrocarbon group with 1 to 4 carbon atoms or hydrogen, and still more preferably hydrogen; X represents oxygen or sulfur, and preferably oxygen.

[Chemical Formula 5]

(9)

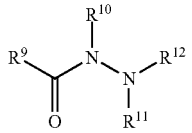

wherein $R^9$ is a hydrocarbon group with 1 to 30 carbon atoms or a hydrocarbon group with 1 to 30 carbon atoms having functionality, preferably a hydrocarbon group with 10 to 30 carbon atoms or a hydrocarbon group with 10 to 30 carbon atoms having functionality, more preferably an alkyl group with 12 to 20 carbon atoms, an alkenyl group with 12 to 20 carbon atoms or a hydrocarbon group with 12 to 20 carbon atoms having functionality, and particularly preferably an alkenyl group with 12 to 20 carbon atoms; $R^{10}$, $R^{11}$ and $R^{12}$ each individually represent a hydrocarbon group with 1 to 30 carbon atoms, a hydrocarbon group with 1 to 30 carbon atoms having functionality or hydrogen, preferably a hydrocarbon group with 1 to 10 carbon atoms, a hydrocarbon group with 1 to 10 carbon atoms having functionality or hydrogen, more preferably a hydrocarbon group with 1 to 4 carbon atoms or hydrogen, and still more preferably hydrogen.

Examples of the nitrogen containing compounds represented by the formula (8) specifically include hydrazides having a hydrocarbon group with 1 to 30 carbon atoms or a hydrocarbon group with 1 to 30 carbon atoms having functionality and derivatives thereof. In the case where $R^9$ is a hydrocarbon group with 1 to 30 carbon atoms or a hydrocarbon group with 1 to 30 carbon atoms having functionality, and $R^{10}$ to $R^{12}$ are hydrogen, the nitrogen containing compound is hydrazides having a hydrocarbon group with 1 to 30 carbon atoms or a hydrocarbon group with 1 to 30 carbon atoms having functionality; in the case where one of $R^9$ and $R^{10}$ to $R^{12}$ is a hydrocarbon group with 1 to 30 carbon atoms or a hydrocarbon group with 1 to 30 carbon atoms having functionality, and the rest of $R^{10}$ to $R^{12}$ is hydrogen, the nitrogen containing compound is N-hydrocarbylhydrazide (hydrocarbyl represents a hydrocarbon group and the like) having a hydrocarbon group with 1 to 30 carbon atoms or a hydrocarbon group with 1 to 30 carbon atoms having functionality.

In the lubricant oil composition according to the present embodiment, in the case where the ash-free friction modifier is used, the content of the ash-free friction modifier is preferably not less than 0.01% by mass, more preferably not less than 0.1% by mass, and still more preferably not less than 0.3% by mass, and preferably not more than 3% by mass, more preferably not more than 2% by mass, and still more preferably not more than 1% by mass based on the whole amount of the composition. At a content of the ash-free friction modifier less than 0.01% by mass, the effect of reducing friction by addition thereof tends to be insufficient; at a content more than 3% by mass, the effect of an anti-wear additive or the like tends to be inhibited, or the solubility of the additive tends to be reduced.

In the present embodiment, only one of the organic molybdenum compound and the ash-free friction modifier may be used, or both thereof may be used in combination; use of the ash-free friction modifier is more preferable.

In order to further improve the performance, any additives usually used for the lubricant oil according to the purpose can be contained in the lubricant oil composition according to the present embodiment. Examples of such an additive can include additives such as a metallic detergent, an ash-free dispersant, an antioxidant, a wear-resistant agent (or extreme-pressure agent), a corrosion inhibitor, a rust inhibitor, a pour-point depressant, an antiemulsifier, a metal deactivator, and an antifoaming agent.

Examples of the metallic detergent include normal salts, basic normal salts or overbased salts of alkali metal sulfonates or alkaline earth metal sulfonates, alkali metal phenates or alkaline earth metal phenates, and alkali metal salicylates or alkaline earth metal salicylates. In the present embodiment, one or two or more alkali metal or alkaline earth metallic detergents selected from the group consisting of these, particularly alkaline earth metallic detergents can be preferably used. Particularly, magnesium salts and/or calcium salts are preferably used, and calcium salts are more preferably used.

As the ash-free dispersant, any ash-free dispersant used for the lubricant oil can be used; examples thereof include mono- or bis-succinimide having at least one linear or branched alkyl group or alkenyl group with 40 to 400 carbon atoms in the molecule, benzylamines having at least one alkyl group or alkenyl group with 40 to 400 carbon atoms in the molecule, polyamines having at least one alkyl group or alkenyl group with 40 to 400 carbon atoms in the molecule, boron compounds of these, and modified products with carboxylic acid, phosphoric acid or the like. In use, one or two or more arbitrarily selected from these can be blended.

Examples of the antioxidant include ash-free antioxidants such as phenol antioxidants and amine antioxidants and metallic antioxidants such as copper antioxidants and molybdenum antioxidants. Specifically, examples of the phenol ash-free antioxidants include 4,4'-methylene-bis-(2,6-di-tert-butylphenol) and 4,4'-bis-(2,6-di-tert-butylphenol), and examples of the amine ash-free antioxidants include phenyl-α-naphthylamine, alkylphenyl-α-naphthylamine, and dialkyldiphenylamine.

As the wear-resistant agent (or extreme-pressure agent), any wear-resistant agents and extreme-pressure agents used for the lubricant oil can be used. For example, sulfur extreme-pressure agents, phosphorus extreme-pressure agents, and sulfur-phosphorus extreme-pressure agents can be used; specifically, examples thereof include phosphorous acid esters, thiophosphorous acid esters, dithiophosphorous acid esters, tithiophosphorous acid esters, phosphoric acid esters, thiophosphoric acid esters, dithiophosphoric acid esters, trithiophosphoric acid esters, amine salts thereof, metal salts thereof, derivatives thereof, dithiocarbamates, zinc dithiocarbamate, molybdenum dithiocarbamate, disulfides, polysulfides, olefin sulfides, and sulfurized fats and oils. Among these, addition of a sulfur extreme-pressure agent is preferable, and particularly sulfurized fats and oils are preferable.

Examples of the corrosion inhibitor include benzotriazole compounds, tolyltriazole compounds, thiadiazole compounds, or imidazole compounds.

Examples of the rust inhibitor include petroleum sulfonates, alkylbenzene sulfonates, dinonylnaphthalene sulfonates, alkenyl succinic acid esters, or polyhydric alcohol esters.

As the pour-point depressant, for example, polymethacrylate polymers or the like suitable for the lubricant base oil to be used can be used.

Examples of the antiemulsifier include polyalkylene glycol nonionic surface active agents such as polyoxyethylene alkyl ether, polyoxyethylene alkyl phenyl ether, or polyoxyethylene alkyl naphthyl ether.

Examples of the metal deactivator include imidazolines, pyrimidine derivatives, alkylthiadiazoles, mercaptobenzothiazoles, benzotriazole or derivatives thereof, 1,3,4-thiadiazolepolysulfide, 1,3,4-thiadiazolyl-2,5-bis-dialkyldithiocarbamate, 2-(alkyldithio)benzimidazole, or β-(o-carboxybenzylthio)propionitrile.

Examples of the antifoaming agent include silicone oils, alkenyl succinic acid derivatives, esters of polyhydroxyaliphatic alcohols and long-chain fatty acids, methyl salicylate, and o-hydroxybenzyl alcohols whose kinematic viscosity at 25° C. is 1000 to 100,000 $mm^2/s$.

In the case where these additives are contained in the lubricant oil composition according to the present embodiment, each content is 0.01 to 10% by mass based on the whole amount of the composition.

The kinematic viscosity at 100° C. of the lubricant oil composition according to the present embodiment is preferably 9.3 to 10 $mm^2/s$, preferably not less than 9.35 $mm^2/s$, and more preferably not less than 9.4 $mm^2/s$. The kinematic viscosity at 100° C. of the lubricant oil composition according to the present embodiment is preferably not more than 9.9 $mm^2/s$, and more preferably not more than 9.8 $mm^2/s$. At a kinematic viscosity at 100° C. less than 9.3 $mm^2/s$, insufficient lubricating properties may be caused; at a kinematic viscosity at 100° C. more than 10 $mm^2/s$, a necessary low temperature viscosity and sufficient fuel efficiency performance may not be obtained.

The kinematic viscosity at 40° C. of the lubricant oil composition according to the present embodiment is preferably 45 to 55 $mm^2/s$, preferably 46 to 54 $mm^2/s$, and more preferably 47 to 53 $mm^2/s$. At a kinematic viscosity at 40° C. less than 45 $mm^2/s$, insufficient lubricating properties may be caused; at a kinematic viscosity at 40° C. more than 55 $mm^2/s$, a necessary low temperature viscosity and sufficient fuel efficiency performance may not be obtained.

The viscosity index of the lubricant oil composition according to the present embodiment is preferably in the range of 140 to 350, more preferably not less than 150, still more preferably not less than 160, and further preferably not less than 170. The viscosity index of the lubricant oil composition according to the present embodiment is preferably not more than 300, more preferably not more than 250, and particularly preferably not more than 200. At a viscosity index of the lubricant oil composition according to the present embodiment less than 140, it may be difficult to improve the fuel efficiency while the HTHS viscosity at 150° C. is kept, and further, it may be difficult to reduce the low temperature viscosity at −30° C. or less. At a viscosity index of the lubricant oil composition according to the present embodiment not less than 350, the low temperature fluidity may be reduced, and further, malfunctions caused by insufficient solubility of the additive and adaptability to a sealing material may be caused.

The HTHS viscosity at 150° C. of the lubricant oil composition according to the present embodiment is preferably not less than 2.9 mPa·s. The HTHS viscosity at 150° C. of the lubricant oil composition according to the present embodiment is preferably not more than 4.0 mPa·s, more preferably not more than 3.3 mPa·s, still more preferably not more than 3.1 mPa·s, and particularly preferably not more than 3.0 mPa·s. At a HTHS viscosity at 150° C. less than 2.9 mPa·s, insufficient lubricating properties may be caused; at a HTHS viscosity at 150° C. more than 4.0 mPa·s, a necessary low temperature viscosity and sufficient fuel efficiency performance may not be obtained.

The HTHS viscosity at 100° C. of the lubricant oil composition according to the present embodiment is preferably not less than 3.0 mPa·s, preferably not less than 4.0 mPa·s, more preferably not less than 4.5 mPa·s, particularly preferably not less than 5.0 mPa·s, and most preferably not less than 5.2 mPa·s. The HTHS viscosity at 100° C. of the lubricant oil composition according to the present embodiment is preferably not more than 8.0 mPa·s, preferably not more than 7.5 mPa·s, more preferably not more than 7.0 mPa·s, and particularly preferably not more than 6.5 mPa·s. The HTHS viscosity at 100° C. here designates the high temperature high shear viscosity at 100° C. specified by ASTM D4683. At a kinematic viscosity at 100° C. less than 3.0 mPa·s, insufficient lubricating properties may be caused; at a kinematic viscosity at 100° C. more than 8.0 mPa·s, a necessary low temperature viscosity and sufficient fuel efficiency performance may not be obtained.

The ratio (HTHS viscosity at 150° C./HTHS viscosity at 100° C.) of the HTHS viscosity at 150° C. to the HTHS viscosity at 100° C. of the lubricant oil composition according to the present embodiment is preferably not less than 0.43, more preferably not less than 0.44, still more preferably not less than 0.45, and particularly preferably not less than 0.46. At a ratio less than 0.43, sufficient fuel efficiency performance may not be obtained because viscosity temperature properties are reduced.

The lubricant oil composition according to the present embodiment is the one whose fuel efficiency and lubricating properties are high, and in which without using a synthetic oil such as a poly-α-olefin base oil and an ester base oil or a low viscosity mineral base oil, the kinematic viscosities at 40° C. and 100° C. and HTHS viscosity at 100° C. of the lubricant oil are reduced, which is effective in improvement in fuel efficiency, while the HTHS viscosity at 150° C. is kept at a constant level. The lubricant oil composition according to the present embodiment having such high properties can be suitably used as fuel-efficient engine oils such as fuel-efficient gasoline engine oils and fuel-efficient diesel engine oils.

EXAMPLES

Hereinafter, based on Examples and Comparative Examples, the present invention will be more specifically described, but the present invention will not be limited to Examples below.

Examples 1 to 4, Comparative Examples 1 to 5

In Examples 1 to 4 and Comparative Examples 1 to 5, a lubricant oil composition was prepared using the base oil and additive shown below. Properties of Base Oils X and Y are shown in Table 1, properties of Viscosity Index Improvers A-1, D-1, and B-1 to B-3 are shown in Table 2, and the compositions of the lubricant oil compositions are shown in Tables 3 and 4. In Table 2, the kinematic viscosity at 40° C., kinematic viscosity at 100° C., viscosity index, HTHS viscosity at 100° C., HTHS viscosity at 150° C., viscosity increasing effects A and B, and the ratio A/B of the mixture obtained by adding 3.0% by mass of each of the viscosity index improvers based on the whole amount to Base Oil X are shown.

(Base Oils)

Base Oil X: Group III base oil produced by hydrocracking

Base Oil Y: wax isomerized base oil produced by wax isomerization (Viscosity Index Improver)

A-1: styrene-isoprene hydrogenated copolymer, $M_W$=50,000, PSSI=5

D-1: dispersion type polymethacrylate, $M_W$=400,000, PSSI=50

B-1: dispersion type polymethacrylate (methacrylate copolymer containing methyl methacrylate, methacrylate in which $R^2$ in the formula (5) is an alkyl group with 12 carbon atoms, methacrylate in which $R^2$ in the formula (5) is an alkyl group with 13 carbon atoms, methacrylate in which $R^2$ in the formula (5) is an alkyl group with 14 carbon atoms, and methacrylate in which $R^2$ in the formula (5) is an alkyl group with 15 carbon atoms, and dimethylaminoethyl methacrylate) $M_W$=80,000, Mw/Mn=2.7, PSSI=5

B-2: polymethacrylate/ethylene-propylene copolymer mixture, PSSI=30

B-3: ethylene-propylene copolymer, $M_W$=250,000, PSSI=24

(Other Additive)

C: Performance additive package (containing a metal detergent, an ash-free dispersant, an antioxidant, an anti-wear additive, an antifoaming agent, and the like)

[Evaluation of Lubricant Oil Composition]

For each of the lubricant oil compositions of Examples 1 to 3 and Comparative Examples 1 to 5, the kinematic viscosity at 40° C. or 100° C., the viscosity index, and the HTHS viscosity at 100° C. or 150° C. were measured. Measurement of values of the respective physical properties was made by the following evaluation methods. Each of the compositions was blended such that the shear viscosity might be 9.3 $mm^2/s$. The obtained results are shown in Tables 3 and 4.

(1) Kinematic viscosity: ASTM D-445

(2) Viscosity index: JIS K 2283-1993

(3) Shear viscosity (diesel injector method): ASTM D-6278

(4) HTHS viscosity: ASTM D4683

The evaluation criterion of the results is that the HTHS viscosity at 100° C. satisfies not more than 6.2 mPa·s while the HTHS viscosity at 150° C. is kept at not less than 2.9 mPa·s, and the kinematic viscosity at 40° C. and the kinematic viscosity at 100° C. are sufficiently low.

TABLE 1

| | Units | Base oil X | Base oil Y |
|---|---|---|---|
| Density (15° C.) | $g/cm^3$ | 0.8347 | 0.820 |
| Kinematic viscosity (40° C.) | $mm^2/s$ | 19.63 | 15.8 |
| Kinematic viscosity (100° C.) | $mm^2/s$ | 4.276 | 3.854 |

TABLE 1-continued

| | | Units | Base oil X | Base oil Y |
|---|---|---|---|---|
| Viscosity index | | | 126 | 141 |
| HTHS viscosity (100° C.) | | mPa · s | 3.287 | |
| HTHS viscosity (150° C.) | | mPa · s | 1.636 | |
| Pour point | | ° C. | −17.5 | −22.5 |
| Aniline point | | ° C. | 115.7 | 118.5 |
| Iodine number | | | 0.05 | 0.06 |
| Sulfur content | | Mass ppm | <1 | <1 |
| Nitrogen content | | Mass ppm | <3 | <3 |
| n-d-M Analysis | % $C_P$ | | 80.7 | 93.3 |
| | % $C_N$ | | 19.3 | 6.7 |
| | % $C_A$ | | 0 | 0 |
| Separation by chromatography | Saturated content | % By mass | 99.7 | 99.6 |
| | Aromatic content | % By mass | 0.2 | 0.2 |
| | Resin content | % By mass | 0.1 | 0.1 |
| | Recover rate | % By mass | 100 | 99.9 |
| Paraffin content based on saturated content | | % By mass | 53.8 | 87.1 |
| Naphthene content based on saturated content | | % By mass | 46.2 | 12.9 |
| Properties of distillation | IBP | ° C. | 313.7 | 363.0 |
| | 10% | ° C. | 393.4 | 396.0 |
| | 50% | ° C. | 426.3 | 432.0 |
| | 90% | ° C. | 459.3 | 459.0 |
| | FBP | ° C. | 504.6 | 489.0 |

TABLE 2

| Viscosity index improver | Units | (Base oil used: Base Oil X) A-1 | D-1 | B-1 | B-2 | B-3 |
|---|---|---|---|---|---|---|
| Amount to be added | % By mass | 3.0 | 3.0 | 3.0 | 3.0 | 3.0 |
| Kinematic viscosity (40° C.) | $mm^2/s$ | 21.8 | 25.2 | 24.2 | 31.1 | 25.7 |
| Kinematic viscosity (100° C.) | $mm^2/s$ | 4.70 | 5.97 | 5.30 | 6.52 | 5.42 |
| Viscosity index | | 138 | 197 | 161 | 170 | 153 |
| HTHS viscosity (100° C.) | mPa · s | 3.44 | 3.94 | 3.95 | 4.47 | 3.94 |
| HTHS viscosity (150° C.) | mPa · s | 1.72 | 2.00 | 1.94 | 2.20 | 1.91 |
| Viscosity increasing effect A | $mm^2/s$ | 0.14 | 0.57 | 0.34 | 0.75 | 0.38 |
| Viscosity increasing effect B | mPa · s | 0.03 | 0.12 | 0.10 | 0.19 | 0.09 |
| A/B | | 5.21 | 4.63 | 3.31 | 3.99 | 4.22 |

TABLE 3

| | | Units | Example 1 | Example 2 | Example 3 | Example 4 |
|---|---|---|---|---|---|---|
| Base oil | Base oil X | % By mass | The rest | The rest | The rest | — |
| | Base oil Y | % By mass | — | — | — | The rest |
| Additive | A-1 | % By mass | 9.49 | 8.94 | 6.92 | 11.34 |
| | D-1 | % By mass | — | — | — | — |
| | B-1 | % By mass | 2.51 | — | — | 2.06 |
| | B-2 | % By mass | — | 1.74 | — | — |
| | B-3 | % By mass | — | — | 4.21 | — |
| | C | % By mass | 10 | 10 | 10 | 10 |
| Properties of lubricant oil composition | Kinematic viscosity (40° C.) | $mm^2/s$ | 48.0 | 50.6 | 51.1 | 45.5 |
| | Kinematic viscosity (100° C.) | $mm^2/s$ | 9.42 | 9.78 | 9.73 | 9.41 |
| | Viscosity index | | 184 | 183 | 179 | 197 |
| | Shear viscosity (DI method, 100° C.) | $mm^2/s$ | 9.3 | 9.3 | 9.3 | 9.3 |
| | HTHS viscosity (100° C.) | mPa · s | 6.14 | 6.15 | 6.15 | 6.07 |
| | HTHS viscosity (150° C.) | mPa · s | 2.90 | 2.90 | 2.90 | 2.90 |
| | Ratio of HTST viscosity (150° C.)/HTST viscosity (100° C.) | | 0.47 | 0.47 | 0.47 | 0.47 |

TABLE 4

| | | Units | Comparative Example 1 | Comparative Example 2 | Comparative Example 3 | Comparative Example 4 | Comparative Example 5 |
|---|---|---|---|---|---|---|---|
| Base oil | Base oil X | % By mass | The rest | The rest | The rest | The rest | The rest |
| | Base oil Y | % By mass | — | — | — | — | — |

TABLE 4-continued

| | | Units | Comparative Example 1 | Comparative Example 2 | Comparative Example 3 | Comparative Example 4 | Comparative Example 5 |
|---|---|---|---|---|---|---|---|
| Additive | A-1 | % By mass | — | — | — | — | — |
| | D-1 | % By mass | 2.33 | 6.88 | — | — | — |
| | B-1 | % By mass | 4.85 | — | 7.33 | — | — |
| | B-2 | % By mass | — | — | — | 4.59 | — |
| | B-3 | % By mass | — | — | — | — | 8.09 |
| | C | % By mass | 10 | 10 | 10 | 10 | 10 |
| Properties of lubricant oil composition | Kinematic viscosity (40° C.) | $mm^2/s$ | 49.1 | 52.9 | 47.2 | 54.4 | 53.6 |
| | Kinematic Viscosity (100° C.) | $mm^2/s$ | 10.20 | 11.64 | 9.47 | 10.47 | 10.06 |
| | Viscosity index | | 202 | 222 | 190 | 186 | 178 |
| | Shear viscosity (DI method, 100° C.) | $mm^2/s$ | 9.3 | 9.3 | 9.3 | 9.3 | 9.3 |
| | HTHS viscosity (100° C.) | mPa · s | 6.59 | 6.64 | 6.56 | 6.54 | 6.37 |
| | HTHS viscosity (150° C.) | mPa · s | 3.15 | 3.20 | 3.13 | 3.10 | 3.02 |
| | Ratio of HTST viscosity (150° C.)/HTST viscosity (100° C.) | | 0.48 | 0.48 | 0.48 | 0.47 | 0.47 |

From the results shown in Tables 3 and 4, it turns out that in the lubricant oil compositions of Examples 1 to 4, the HTHS viscosity at 150° C. is sufficiently high, and the kinematic viscosity at 40° C., kinematic viscosity at 100° C. and HTHS viscosity at 100° C. are sufficiently low.

The invention claimed is:

1. A lubricant oil composition comprising:

a lubricant base oil whose kinematic viscosity at 100° C. is 1 to 6 $mm^2/s$, % $C_p$ is not less than 70, and % $C_A$ is not more than 2;

a first viscosity index improver in which a ratio A/B of a viscosity increasing effect A of a kinematic viscosity at 100° C. represented by a following equation (1) to a viscosity increasing effect B of an HTHS viscosity at 150° C. represented by a following equation (2) when added to the lubricant base oil is a value of not less than 4.5, and a PSSI is not more than 30; and a second viscosity index improver in which the ratio A/B of the viscosity increasing effect A of the kinematic viscosity at 100° C. represented by the following equation (1) to the viscosity increasing effect B of the HTHS viscosity at 150° C. represented by the following equation (2) when added to the lubricant base oil is a value less than 4.5:

$$A=X-X_0 \quad (1)$$

wherein A represents a viscosity increasing effect of the kinematic viscosity at 100° C., X represents a kinematic viscosity at 100° C. [units: $mm^2/s$] of a mixture of the lubricant base oil with 3% by mass of the first or second viscosity index improver, and $X_0$ represents a kinematic viscosity at 100° C. [units: $mm^2/s$] of the lubricant base oil, $$B=Y-Y_0 \quad (2)$$

wherein B represents a viscosity increasing effect of the HTHS viscosity at 150° C., Y represents an HTHS viscosity at 150° C. [units: mPa·s] of a mixture of the lubricant base oil with 3% by mass of the first or second viscosity index improver, and $Y_0$ represents an HTHS viscosity at 150° C. [units: mPa·s] of the lubricant base oil.

2. The lubricant oil composition according to claim 1, wherein the second viscosity index improver is a polymethacrylate with a PSSI of not more than 30.

3. The lubricant oil composition according to claim 1, wherein the PSSI of the first viscosity index improver is not more than 20, and the second viscosity index improver is a polymethacrylate with a PSSI of not more than 30.

* * * * *